United States Patent [19]

Dierckx

[11] 3,980,417

[45] Sept. 14, 1976

[54] APPARATUS FOR INCINERATING NON-HALOGENATED WASTE LIQUIDS

[75] Inventor: Peter Gerard Dierckx, Mortsel, Belgium

[73] Assignee: AFGA-GEVAERT N.V., Mortsel, Belgium

[22] Filed: Nov. 27, 1974

[21] Appl. No.: 527,595

[30] Foreign Application Priority Data

Nov. 29, 1973 United Kingdom ..... 55391/73

[52] U.S. Cl. ..... 431/284; 110/7 B; 239/424.5

[51] Int. Cl.[2] ..... B05B 7/08; F23G 7/00

[58] Field of Search ..... 239/422, 423, 424, 424.5; 431/284, 285; 110/7 S, 7 B

[56] References Cited

UNITED STATES PATENTS

| | | | |
|---|---|---|---|
| 3,115,924 | 12/1963 | Massier | 431/284 |
| 3,578,246 | 5/1971 | Davis, Sr. | 239/424.5 |
| 3,718,102 | 2/1973 | Hemsath et al. | 431/284 X |
| 3,777,983 | 12/1973 | Hibbins | 239/422 |
| 3,861,857 | 1/1975 | Straitz | 431/285 |

*Primary Examiner*—Kenneth W. Sprague
*Attorney, Agent, or Firm*—William J. Daniel

[57] ABSTRACT

An installation for burning waste solvents is characterized by the use of a concentrically constructed nozzle by means of which the waste solvents and a mixture of compressed air and fuel may be burned simultaneously. The compressed air/fuel mixture may either serve to warm up the incinerator prior to the introduction therein of the waste solvents or may be used to support the incineration of waste solvents when the latter have a low heat value.

5 Claims, 8 Drawing Figures

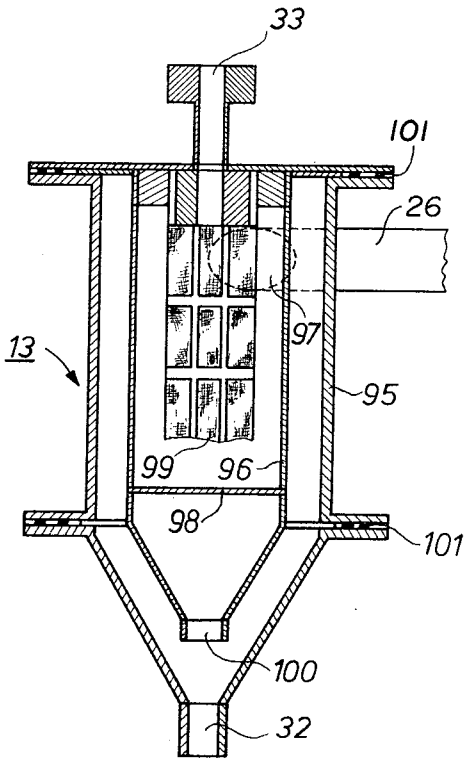
Fig. 5
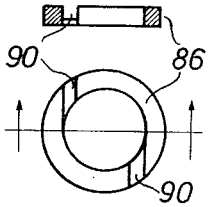
Fig. 4c
Fig. 4b
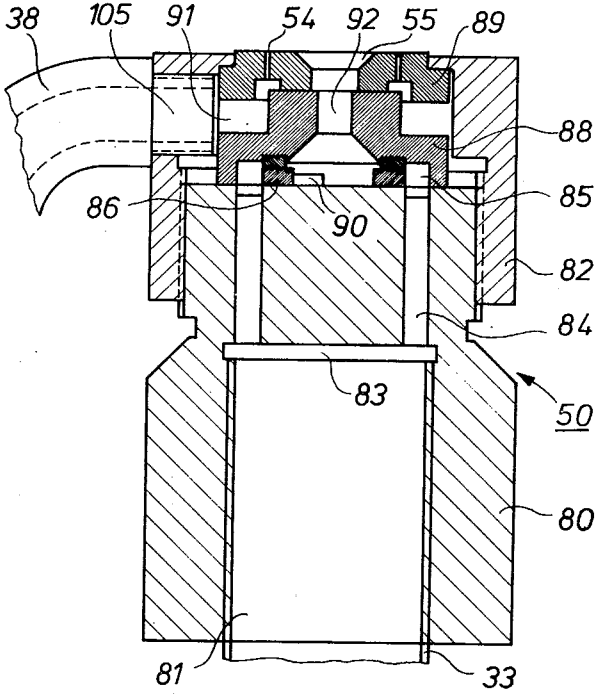
Fig. 4a

APPARATUS FOR INCINERATING NON-HALOGENATED WASTE LIQUIDS

This invention is concerned with an installation for burning waste products in liquid form. More particularly, it is concerned with apparatus intended for incinerating non-halogenated industrial waste solvents without excessive danger for environmental contamination.

Until now, the destruction of non-halogenated organic industrial waste products occurred for the greater part in more or less conventional incinerators in which the solvent to be incinerated is mixed with air, whereinafter the mixture is ignited. A main inconvenience of this method is the fact that solvents having a very low heat of combustion (or heat value) or solvents having a relatively high water content may not be burned or incinerated satisfactorily, so that combustion becomes incomplete, causing the liberation of smokes and fumes which may be noxious even at low concentrations. Moreover, the continued and fluent running of the incineration process itself is only moderately guaranteed. It has been tried to remedy to the above-metnioned drawback by providing a kind of after-burner at the exit end of the installation, whereby the flue gases are once again submitted to an oxidation process so that the chance of conversion into stable oxides is raised considerably.

Although this method has the advantage of giving more complete combustion as compared with conventional incinerators, the problem of burning liquids having a low heat of combustion still remains. Moreover, since the after-burning installation is located in downstream direction of the incinerator, the temperature of the flue gases may decrease considerably, so that more supplementary caloric energy than necessary must be supplied. Also the necessity to install the after-burner in the exhaust compartment of the installation, for example in the stack, results in greater dimensions of the latter, so that the costs of installation may rise considerably.

A first object of the invention is to remedy to the above described drawbacks.

Another object of the invention is the provision of an apparatus by means of which after-burning is not necessary.

A third object of the invention is the provision of an installation by means of which a great variety of organic solvents, even contaminated with water and/or solid substances may be incinerated. Yet another object of the invention is the provision of an installation by means of which solvents having a low heat of combustion may be incinerated.

Still another object of the invention is the provision of an installation for incinerating waste solvents which may operate continuously.

A further object of the invention is to provide a nozzle by means of which the continuous and fluent incineration of a great variety of solvents or mixtures of solvents is rendered possible.

Supplementary advantages of an incinerator for burning waste solvents according to the invention will become clear in the course of this description.

According to the invention, there is provided an installation for incinerating waste non-halogenated solvents, comprising:

an incinerator vessel a burner assembly attached to said incinerator vessel for the stream of a mixture of compressed air and fuel, and comprising a nozzle unit conduit means for delivering under pressure a stream of waste solvent to the nozzle of said nozzle unit, and conduit means for introducing a stream of a mixture of fuel and air through a plurality of orifices concentrically arranged around said nozzle into the incinerator vessel, pump means for delivering solvent to said burner assembly a source of compressed air a storage vessel for fuel conduit means for passing a mixture of compressed air and fuel from said source and storage vessel to said burner assembly a stack for discharging effluent gases from the incinerator into the atmosphere a mantle disposed around said burner assembly conduit means for passing air through said mantle and externally around said nozzle of said burner assembly into the incinerator, whereby the flame of the combusting mixture at the nozzle is stabilized fan means for introducing air into said mantle and means to sieve the solvents prior to incinerating.

The scope and spirit of the invention will be more clearly understood in the light of a description of a preferred embodiment with reference to the annexed figures, in which:

FIGS. 4*b* and 4*c* show a detail of the nozzle unit of FIG. 4*a*

FIG. 5 represents a sieving device through which the waste solvents are filtered prior to incincerating.

Figure 1:
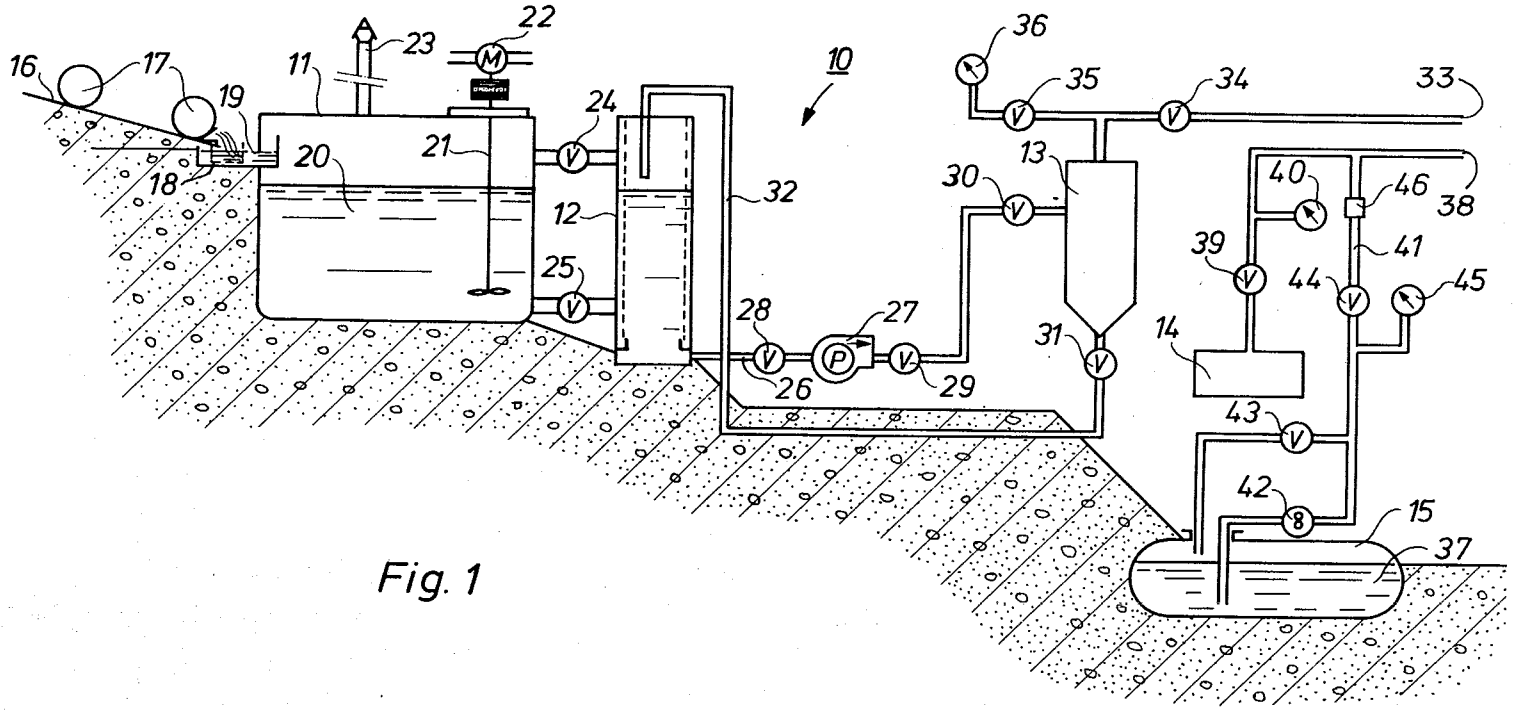
FIG. 1 is a schematic representation of the installation prior to the burning stage.

The incineration installation 10 depicted in FIG. 1 comprises the following main parts upstream of the burner assembly: a collecting tank 11 communicating with a first sieve tank 12, a second sieve tank 13 equipped with means for controlling the flow of solvents towards the burner assembly, a source of compressed air 14 and a storage tank 15 in which fuel having a high heat of combustion for example gas oil is stocked. At the entry side of the installation is provided an inclined plate 16 which serves to guide the containers 17, containing the waste solvents, towards the entry of collecting tank 11. The latter is provided with a coarse sieve 18 is order to retain the very coarse particles, larger than 5 mm diameter such as parts of broken bottles, pieces of cork, etc. which may be present in the waste solvents. The sieve 18 itself is mounted in a water-sealed casing 19, masking the opening of collecting tank 11. The waste solvents are continuously stirred in order to form a mixture 20. Stirring is done, for example, by means of a stirrer 21, driven by a motor 22. Occasionally, a flame protecting device 23 may be provided to prevent an accidental burning of the contents of collecting tank 12 from the outside.

At the top and the bottom of collecting tank 11 a pair of valves 24 and 25 are provided through which, by means of appropriate conduits, the collecting tank 11 is connected with a first sieve tank 12. This provision permits to pour a given amount of solvents in the tank 12, whereinafter the latter may be disconnected from the collecting tank 11. In this way the large collecting tank 11 need not necessarily be permanently connected to the other parts of the installation. In the meantime, solid parts which were not withheld by the sieve 18 at the entry of the collecting tank 11 may be collected.

The first sieve tank 12 is connected by the conduit 26 to a second sieve tank 13 which is equipped with means for flow regulation of the waste solvents. To this end is provided a centrifugal pump 27 which has at its inlet and outlet openings respectively the valves 28 and 29 for the purpose of easy removal of said pump when overhauling of the latter is necessary. A valve 30 is provided at the inlet of the second sieve tank 13. At the bottom of the second sieve tank are provided valve 31 and conduit 32, the latter ending at the top of first sieve tank 12. In so doing a closed circuit is built up and the returning flow through conduit 32 is regulated by the gradual opening or closing of valve 31. The net flow towards the burner assembly itself goes through the top of the second sieve tank 13 by means of conduit 33, which is equally provided with a valve 34.

Figure 2B:
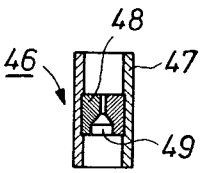
FIG. 2*b* is a detail of a part of 2*a*.

The pressure by which the waste solvents are fed to the burner may be read on manometer 36. Therefore, valve 35 is periodically opened. The further treatment of the flow of solvents is illustrated in FIG. 2.

An auxilairy circuit is provided by means of which a mixture of compressed air and fuel having a high heat of combustion may be directed to the burner assembly. For this purpose a source of compressed air 14 feeds air towards the burner through conduit 38 when opening valve 39. The pressure itself is indicated by manometer 40. A second conduit 41 is joined to conduit 38 through which a combined stream of compressed air and fuel from fuel tank 37 is fed (details see FIG. 2). A high pressure pump, for example a gear pump 42 is provided, an by means of valves 43 and 44 the flow of the fuel (preferably gas oil) may be varied within a wide range. A manometer 45 permits the reading of the pressure at which the fuel is distributed.

Figure 2A:
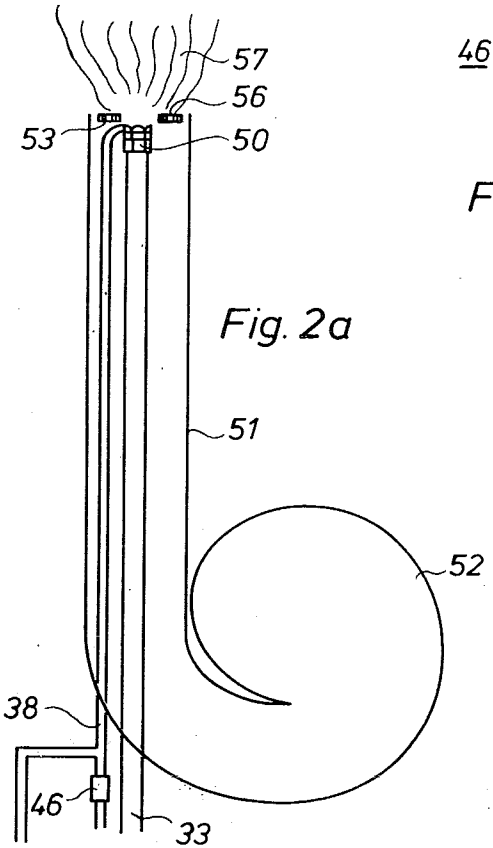
FIG. 2*a* is a view of a burner assembly.

FIG. 2*a* shows the general construction of the burner assembly. The burner assembly contains a nozzle unit 50 which is capable of projecting finely divided droplets of waste solvents through a central opening 55 (FIG. 4*a*) and at the same time directing a mixture of compressed air and fuel through a plurality of orifices 54 (FIG. 4*a*) lying concentrically with the central opening 55.

Prior to the mixing with compressed air, the fuel is passed via conduit 41 through an element 46 (see FIG. 2*b*), consisting essentially of a tubular body 47 in which an atomizing orifice 48 is provided, the latter having an axially extending opening 49 which gradually decreases its diameter in downstream direction.

Details of the nozzle unit 50 may be found in FIGS. 4*a*, 4*b* and 4*c*. Concentrically arranged around the conduit 33, through which pass the waste solvents, is a mantle 51 (FIG. 2*a*) through which the flow of atmospheric air at slightly overpressure is forwarded towards the nozzle of nozzle unit 50. Said airflow is delivered by a fan 52, which may be provided with filtering devices (not shown).

At the exit side of the installation, a plate 53 showing a plurality of holes 56 is arranged which provides for the dividing of the main airflow from the fan into samll streams. This results in a broadening of the base of the flame 57, which involves a stabilization of the flame.

Figure 3:
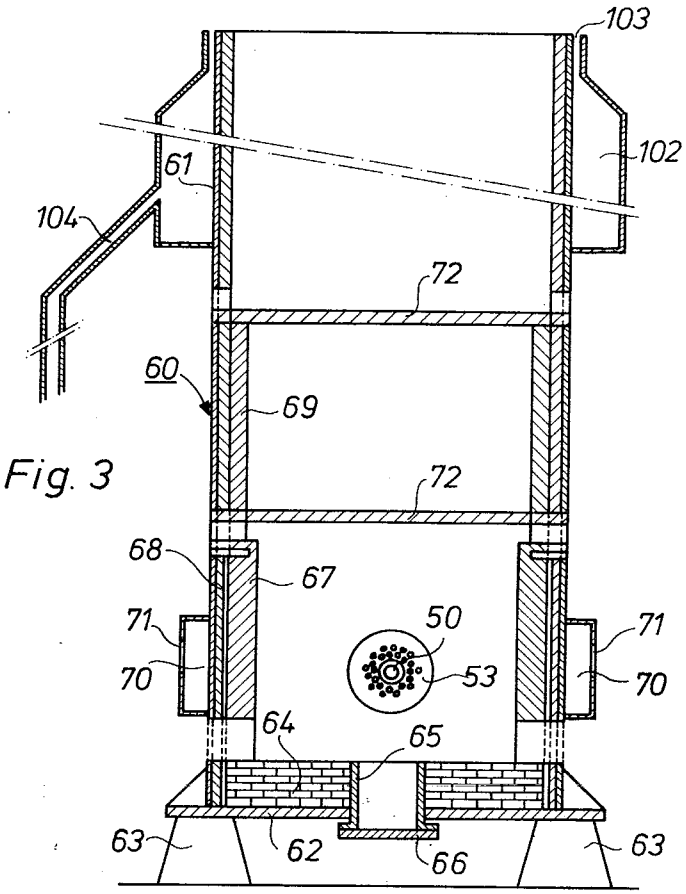
FIG. 3 is a cross-sectional view of the incinerator, FIG. 4*a* gives a cross-sectional view of the nozzle unit.

FIG. 3 represents a sectional view of the incinerator 60 itself. The place where the burner enters the incinerator is given by the position of the plate 53 and the nozzle unit 50.

The incinerator has a mantle 61, preferably made of steel, which may attain a height of several meters, resting on a platform 62, the latter being supported by a number of blocks 63. On the platform 62 is provided a base 64 comprising a plurality of layers of fire-proof bricks. The bottom 64 and the platform 62 are perforated, preferably at their central area by means of a heavy metallic tube 65 of large diameter, which may be closed by means of a plate 66. This plate 66 may periodically be taken away for the purpose of ash removal.

Concentrically arranged at the inner side of the mantle 61 are provided a number of layers of refractory material 67, 68 and 69, the thickness of which gradually decreases towards the top of the incinerator. A channel 70 concentrically arranged around the mantle 61 may be provided in order to operate as an economizer. In so doing, the air circulating in said space 70, entering the latter through openings 71 may be warmed up before being fed to the fan 52. The heat content accumulated in said heated air may be used advantageously during the burning process. In the area in proximity of the flame at least one deflector 72, covering more than half the surface of the section of the incinerator, may be provided in order to guide the waste gases once again through the very hot area around the flame. At the top of the incinerator, and also concentrically arranged around it there may be provided a second channel 102 which is connected by means of a tube 104 to another fan (not shown). The exit opening 103 is relatively narrow and the air, supplied by the fan is projected through said opening at a relatively high speed. In the preferred embodiment an air curtain having a speed of about 10 meters/second could be built up with the help of a fan capable of delivering 20,000 cubic meters of air per hour at an overpressure of only about 40 millimeters of water column. The provision of this device has two important advantages: a quick diluting of the flue gases and the possibility to operate the installation satisfactorily at quiet periods.

FIGS. 4*a* and 4*b* illustrate the construction of the nozzle unit 50. The nozzle is provided at the exit end of conduit 33. There, a first part 80 of the nozzle unit, having a central opening 81, is screwed upon said conduit. The opening 81 enlarges itself into a space 83 from which a plurality of channels 84 lead the flow of waste solvents to an annular space 85 and an atomizing nozzle portion 92, which is enclosed by a second part 82, screwed onto part 80.

Inside the part 82, is provided a first ring 86 which has two or more tangentially arranged channels 90, so that the solvents pumped at high pressure, are forced from the space 85 through the channels 90 in turbulent motion in the center of the atomizing nozzle portion 92. Ring 86 is provided with a second ring 88, wherein atomization is carried out by the fact that the waste solvents are forced at relatively high pressure to pass through the atomizing nozzle portion 92. The central openings of rings 88 and 89 form a venturi-shaped body.

In the meantime, the mixture of compressed air and fuel arrives through conduit 38 which is connected to the upper part 82 of the nozzle b a hollow screw 105. The mixture then arrives at an annular space 91 and is forced through a plurality of openings 54 lying concentrically with the central opening 55 situated in ring 89. At the outlet of the nozzle a highly turbulent mixture of the waste solvents and the air/fuel mixture is obtained.

Before starting the incineration, only the air/fuel mixture is fed to it and ignited to pre-heat the incinerator. Ignition may be carried out by known means, such as a high-voltage electrical discharge with the help of spark plugs, a torch, etc.

The nozzle unit 50 may be used for a variety of applications.

When solvents having a high heat of combustion are to be incinerated the supply of the air/fuel mixture may be cut off. However, when solvents having a rather low heat of combustion or solvents having a high water content are to be destroyed, the air/fuel mixture is used to support the incineration process, such an installation is adapted for burning a great variety of waste solvents. Among these solvents some may be contaminated with sand or other solid particles. Therefore, the nozzle unit 50 has been constructed to let pass solid particles of dimensions up to for example 2.5 mm. In order to reduce the servicing of the nozzle to a minimum, a sieving device 13 is provided in the main supply line in order to retain all particles greater than 2.5 mm. Such device is represented in FIG. 5.

The flow of waste solvents enters the sieving device 13 through opening 97 at the exit of conduit 26, said exit being tangentially arranged in the outer casing 95 and enclosed in the space defined by the casing 95 and the casing 96. By the fact that the bottom of the sieving device 13 is conically shaped, a hydrocyclonic effect is obtained which causes the heavy particles to stay in downstream direction so that they may escape through opening 32. In the meantime the solvents and the light particles are carried upstream through opening 100 and arrive at a first sieve 98 and further to a sieve 99 which is concentrically arranged with regard to the casing 95. The sieve 99 retains all particles greater than 2.5 mm. The flow of solvents and the small particles leave the device through an opening which leads to conduit 33. Rings 10 made of deformable material provide for a good sealing between the constituting parts.

A series of tests on different waste solvents or mixtures thereof were carried out on the installation according to the invention. Before entering in detail with the description of said tests, the analytical procedure by means of which the nature and the quantity of flue gases and occasional residues were determined will be described.

The flue gases were analysed in two different ways firstly on the spot incinerator site with Dräger-tubes (manufactured by Drägerwerk AG - Lüebeck, Western-Germany) and secondly in the laboratory by means of chromatographic techniques. The solid residues, which were collected at the bottom of the incinerator were analyzed by X-ray diffraction or X-ray fluorescence techniques.

For measuring the amount and nature of the flue gases with Dräger-tubes, a small hand pump is used, which enables a determined amount of gas to be collected per stroke. Thus, one stroke of the hand pump corresponded with an amount of 100 cubic mm. Dräger tubes are manufactured for a great variety of gases. For on-site measurements, the detectors used were capable of detecting carbon dioxide and carbon monoxide. Therefore, the hand pump was held in close proximity of the outlet of the incinerator and a number of stroke were given in order to drive the required amount of flue gas through the Dräger-tube referred to. The presence of a given gas is detected by a colouration of the adsorber present in the tube and the length over which this colouration occurs is a measure for the quantity of gas present in the air. Although a fair approximation may be obtained by this method, the number of flue gases which may be detected is limited. In order to overcome this inconvenience, the mixture of air and flue gases was collected at the outlet of the incinerator by means of a small compressor and stocked at 1.2 atmospheres in a steel bottle. Gaschromatographic experiments resulted in more differentiated results, but introduced new difficulties. Indeed, the water contained in the flue gas mixture condensed in the meantime absorbing a certain quantity of the flue gases, so that the sample was no longer representative. This was overcome by suction of the gases through a tube containing the same adsorber as a chromatographic column. In the laboratory, this tube was heated, so that every substance was liberated again, then the outlet of the tube was guided through a cooler and subsequently fed into a chromatographic column of a Hewlett Packard HP 5750 gaschromatograph with flame ionisation detection.

The solid residues were investigated with the help of a Philips Universal All Vacuum X-Ray spectrometer P 1540 equipped with a Wide Range Goniometer PW 1050 during the X-ray fluorescence spectrographic experiments.

X-ray diffraction of the collected samples was carried out with a Phillips X-ray diffraction Generator PW 1010/30 equipped with a copper anode 25623/62 and a Wide Range Goniometer PS 1050.

Both last mentioned techniques permit to detect the presence of metals.

The above described techniques allowed qualitative and quantitative determination of the residues. At the same time, gaschromatographic investigation was carried out on the mixture of waste solvents to be burned and the heat value of the latter was also determined.

Following examples illustrate the very satisfactory working of the installation according to the invention. In order to show the efficiency of the installation a pair of tests were carried out, wherein the waste solvents were incinerated in an open fire.

EXAMPLE 1

A mixture consisting of 450 l of dimethylformamide, 700 l of isopropanol, 650 l of methanol, 50 l of acetic acid, 250 l of water, 200 l of ethanol and 100 l of a non-defined organic precipitate, was brought in the incinerator and ignited without atomizing. Only 75 liters of this mixture could be incinerated in one hour in this way (open fire).

The heat value of the mixture was 230 Kcal/kg so that a continuous burning of the mixture was not guaranteed.

Smoke formation reaches a very high level and the concentration or unburnt hydrocarbons amounted to 3000 ppm.

EXAMPLE 2

A mixture of 700 l of acetonitrile, 800 l of water, 600 l of isoproponol, 100 l of acetic acid, 1600 l of methanol, 200 l of precipitate (not-defined) and traces of nitrobenzene, was brought in the incinerator in order to be burnt as the mixture of Example I. Moreover, a tube, provided with a series of holes of 2 mm diameter through which compressed air was forced, was positioned at the level of the liquid mixture. The holes lay in close proximity of the surface of the mixture and the compressed air enabled a quick atomization of the latter. The air solvent mixture was then ignited. In so doing, the capacity of the installation could be raised to a burning rate of 150 l/hour. The samples of flue gas at the outlet of the incinerator showed following concentrations: 17.5 percent of oxygen, 3.5 percent of carbon dioxide, 700 ppm of carbon monoxide, 3 ppm of $NO_2$, but were negative for sulphur dioxide, hydrochloric acid and hydrocyanic acid.

Gaschromatographic investigation of the flue gases revealed a peak with the retention time of acetonitrile at a concentration of about 40 mg/m3.

The ashes which were collected at the bottom of the incinerator were investigated by X-ray diffraction and revealed a mixture of sodium chloride, copper(I)- and copper(II)-oxides.

Smoke formation was excessive.

EXAMPLE 3

A mixture of 2590 l of methanol, 10 l of glycol, 50 l of acetic acid, 500 l of water, 160 l of xylene, 350 l of acetone and 140 l of organic precipitate was incinerated in an installation according to the invention. The fan was capable to deliver 10,000 cubic inches of atmospheric air per hour; the source of compressed air delivered 30 cubic meters of air at 4 atmospheres per hour. The consumption of gas-oil was set at 25 liters per hour.

Analysis of flue gases revealed a presence of carbon monoxide (125 ppm), $NO_2$ vapours (less than 0.1 ppm), whereas no trace of hydrogen cyanide, sulphur dioxide, hydrogen chloride or phosgene could be detected.

By gaschromatographic investigation peaks with the retention time of acetone (165 mg/m3) and ethylene glycol (250 mg/m3) were noticed. Smoke formation was strongly reduced.

The temperature in the incinerator amounted to 1000°C. 150 liters per hour could be incinerated in this way.

EXAMPLE 4

A mixture of 1480 l of methanol, 10 l of glycol, 1200 l of water, 800 l of acetone, 720 l of ethanol, 190 l of kerosene, 90 l of pyridine, 40 l of acetic acid, 160 l of xylene, 90 l of hexane, 140 l of a mixture of ethylene glycol and monoethylether, 0.6 l of methyl ethylketone, 9.4 l of butanol, 7 l of dichloroethane and 380 l of organic precipitate was incinerated in an incinerator according to the invention with deflectors in the outlet of the flame chamber.

650 liters of this mixture could be incinerated per hour. At the outlet of the stack a concentration of 4 percent of carbon dioxide and 17 percent of oxygen was found. The temperature in the incinerator amounted to 1320°C, whereas at the outlet of the stack a temperature of 650°C was recorded.

A very thin plume of smoke escaped through the stack.

Analysis of the flue gases gave following results:

carbon dioxide: 530 ppm, $NO_x$: 0.3 ppm hydrogen chloride, hydrogen cyanide, sulphur dioxide and phosgene: negative.

The gaschromatographic analysis of the flue gases collected in the immediate vicinity of the outlet gave retention times for ethanol (7 mg/m3), acetone (30 mg/m3), hexane (13 mg/m3), butanone (2 mg/m3), ethylene glycol (576 mg/m3), pyridine (35 mg/m3) and xylene (9 mg/m3).

The concentrations of the flue gases were compared with the "Maximal Acceptable Concentrations" embedded by the "American Conference of Governmental Industrial Hygienists". From this comparison, it could be derived that the concentrations are far below the levels defined. When moreover, it is considered that on the one hand the samples were taken directly at the outlet of the stack prior to dilution in the atmosphere and that on the other hand those maximal acceptable concentrations are levels that are considered as being continuously tolerable in workshops and laboratories during a 8-hours workday, pollution caused by the installation according to the invention may be practically completely neglected.

From the foregoing, it may be derived that a new and useful apparatus has been devised which may be used to contribute positively in the fight for environmental protection.

It may be equipped with supplementary apparatus permitting an independent, continuous and full automatic working. The description of a preferred embodiment is not limitative for the scope and spirit of the invention, which is defined by the appended statements.

We claim:

1. A nozzle for burning solvents, comprising:

a first body having an axial bore through which solvents are fed and terminating in a plurality of axially extending channels communicating with a first annular chamber, passage means connecting said first annular chamber with an outlet opening of said nozzle and adapted to bring the flow of waste solvents into a turbulent and atomized condition at the outlet opening of said nozzle, and means for feeding a mixture of compressed air and atomized fuel having a high heat of combustion into a second annular chamber spaced from said first annular chamber, said second chamber being provided with a plurality of outlet openings arranged concentrically with said nozzle opening and through which said mixture is forced to the atmosphere.

2. A nozzle according to claim 1, in which said first and second annular chambers are formed by annular clearances between, respectively, a first and a second ring and between said second ring and a third ring.

3. A nozzle according to claim 1, in which said second and third rings are disposed in abutting axial serially contacting relation and the interior openings thereof collectively define a venturi-type nozzle opening.

4. A nozzle according to claim 1, wherein said passage means comprise tangentially directed channels to introduce said solvents into said nozzle outlet opening in a vortical flowing condition.

5. The nozzle of claim 2, wherein said three rings are separate from said first axial body and are secured thereto by means of an exterior collar removably connected to said first body.

* * * * *